US005168198A

United States Patent [19]

Watanabe

[11] Patent Number: 5,168,198

[45] Date of Patent: Dec. 1, 1992

[54] LAMPLIGHT FAILURE DETECTION SYSTEM

[75] Inventor: Toshisuke Watanabe, Tokyo, Japan

[73] Assignee: Kabushiki Kaisha Toshiba, Kanagawa, Japan

[21] Appl. No.: 670,780

[22] Filed: Mar. 19, 1991

[30] Foreign Application Priority Data

Mar. 20, 1990 [JP] Japan ..... 2-070739

[51] Int. Cl.[5] ..... H05B 37/00

[52] U.S. Cl. ..... 315/130; 315/131; 315/256

[58] Field of Search ..... 315/129, 130, 131, 135, 315/185 R, 189, 256, 136, 315; 340/642

[56] References Cited

U.S. PATENT DOCUMENTS

| | | | |
|---|---|---|---|
| 3,829,735 | 8/1974 | Berlock | 315/131 |
| 4,295,079 | 10/1981 | Otsuka et al. | 315/130 |
| 4,396,868 | 8/1983 | Watanabe et al. | 315/130 |
| 4,675,574 | 6/1987 | Delflache | 315/130 |
| 5,034,659 | 7/1991 | Taniguchi | 315/130 |

FOREIGN PATENT DOCUMENTS 61-15556 4/1986 Japan .

*Primary Examiner*—Eugene R. LaRoche
*Assistant Examiner*—A. Zarabian
*Attorney, Agent, or Firm*—Finnegan, Henderson, Farabow, Garrett & Dunner

[57] ABSTRACT

A lamplight failure detection system for detecting lamplight failure in a lamplight circuit, the lamplight circuit having a plurality of lamplight units connected with the secondary side circuits of each of a plurality of current transformers, the current transformers having their primary side circuits connected in series to an alternating current power supply. The lamplight failure detecting system includes a plurality of lamplight failure detectors fitted to each lamplight unit for detecting lamplight failure in the corresponding lamplight unit, a power control unit for repeatedly performing the momentary interruption of the output of the alternating power supply when there is no fault in the lighting of the lamplight unit, a plurality of lamplight circuit control units fitted to each lamplight failure detector for electrically closing the secondary side circuit of the current transformer when a lamplight failure is detected by the lamplight failure detector and for opening the secondary side circuit for a fixed time when a predetermined number of momentary interruptions of the alternating current power supply which occur after the lamplight failure is detected, a lamplight failure judgement unit for detecting lamplight failure based on variations in the outputs of alternating current power supply, and a lamplight failure locator unit for deciding which lamplight units have failed based on the comparison between the number of momentary interruptions from the time when a first lamplight failure is detected to when the next lamplight failure is detected with the predetermined number of momentary interruptions for each of lamplight unit.

8 Claims, 6 Drawing Sheets

Fig. 6(a) OUTPUT CURRENT

Fig. 6(b) OUTPUT VOLTAGE

Fig. 6(c) LAMPLIGHT FAILURE DETECTION SIGNAL

Fig. 6(d) SHORT CIRCUIT SIGNAL

LAMPLIGHT FAILURE DETECTION SYSTEM

BACKGROUND OF THE INVENTION

This invention relates to a lamplight circuit system in which an alternating current (AC) power source is connected to a plurality of lamps, and more particularly to a lamplight failure detection system used for the lamplight circuit system.

Serial lamplight circuits are often used for the many lamps used as landing lights for airport runways. In such serial lamplight circuits, there are detectors which detect when any of these lamps experiences a lamplight failure.

FIG. 1 is a circuit diagram showing a conventional lamplight failure detector.

In FIG. 1, a constant current power source unit 12 supplies electricity to a serial lamplight circuits unit 66 on the basis of a power supply from an alternating current (AC) power source 11. Serial lamplight circuits unit 66 has insulated current transformers $CT_1$, $CT_2 \ldots CT_n$ connected in series on the primary side circuit and lamps $L_1$, $L_2 \ldots L_n$ connected to the secondary side circuit of, respectively, insulated transformers $CT_1$, $CT_2 \ldots CT_n$. The brightness of lamps $L_1$, $L_2 \ldots L_n$ is maintained at a constant level by the current output by constant-current power source unit 12 and supplied to them via insulated transformers $CT_1$, $CT_2 \ldots CT_n$.

Lamplight failure detector 65 detects lamplight failure in $L_1$, $L_2 \ldots L_n$ from changes in signals input via a current transformer 13 and a potential transformer 14.

The process by which lamplight failure detector 65 detects lamplight failure in a lamp is as follows. If any of lamps $L_1$, $L_2 \ldots L_n$ experiences a lamplight failure, the secondary side circuit of the insulated current transformer connected to this lamp becomes open. When the secondary side circuit of the insulated current transformer becomes open, there is change in the load impedance as seen from the constant current power source 12 which supplies current to the lamplight circuit whose lamplight has failed. The output voltage wave form and output current wave-form of the constant current power source unit 12 produced due to the changes in the load impedance are as shown in FIG. 2. The theory of detecting lamplight failures of lamps by this method is described, for example, in JP 61-15556 (B). When the secondary side circuit of the insulated current transformer becomes open due to lamplight failure, there is a consequent magnetic saturation phenomenon and the rise of output current of constant current power source unit 12 is shallow until the insulated current transformer becomes magnetically saturated. The wave form of the output current thus shows a rise which is later than when there is no lamplight failure in the lamp. On the other hand, in the case of the output voltage of the constant current power source unit 12, the rise of the output voltage is steep during the delay in the start of the output current (the saturation time $\alpha$, $\alpha$ is the phase control angle). The time integral values $m_1$, $m_2 \ldots m_n$, equivalent to the parts shown as hatched in FIG. 3, are proportional to the number of lamps with failed lamplights. Thus, if the time integral value when one lamplight has failed is expressed as $m_1$, if the time integral value found from lamplight failure detector is $m_3$, then the number of lamps with failed lamplight is 3.

However, although the conventional lamplight failure detectors are capable of detecting the number of lamplights which have failed they are not capable of detecting which of the series of lamps $L_1$, $L_2 \ldots L_n$ has failed.

Because of this, when the lamplight failure detector 65 detects that there has been a lamplight failure in one of $L_1$, $L_2 \ldots L_n$, an inspector must conduct checks on the lamplights on the runway until the failed lamplight is found. The efficiency of the maintenance and inspection works is thus poor.

If the replacement of the lamp in which the lamplight has failed is delayed, the insulated current transformer connected to the failed lamp is left for a long time with the secondary side circuit in an open state. Consequently, there is a possibility of short circuits in the coil and heat damage caused to the coil by raised temperatures.

SUMMARY OF THE INVENTION

It is an object to improve the efficiency of the maintenance and inspection works for the use of lamplight circuit.

Another object is to make it possible to detect which of the lamplights has failed in a lamplight circuit.

Additional objects and advantages will be obvious from the description which follows, or may be learned by practice of the invention.

The foregoing objects are achieved according to the present invention by providing a lamplight failure detection system for detecting lamplight failure in a lamplight circuit, the lamplight circuit having a plurality of lamplight units connected with the secondary side circuits of each of a plurality of current transformers, the current transformers having their primary side circuits connected in series to an alternating current power supply. The lamplight failure detection system includes a plurality of lamplight failure detector means fitted to each of the lamplight units for detecting a lamplight failure in the corresponding lamplight unit, power control means for performing repeatedly the momentary interruption of the output of the alternating power supply when there is no fault in the lighting of the lamplight unit, a plurality of lamplight circuit control means fitted to each of the lamplight failure detector means for electrically closing the secondary side circuit of the current transformer when a lamplight failure is detected by the lamplight failure detector means and for opening the secondary side circuit for a fixed time when the number of momentary interruptions of the alternating current power supply which occur after the lamplight failure is detected reaches a predetermined number of momentary interruption set for each lamplight unit, lamplight failure judgement means for detecting lamplight failure based on variations in the output of the alternating current power supply, and lamplight failure locator means for deciding which of lamplight units has failed based on the comparison between the number of momentary interruptions from the time a first lamplight failure is detected to when the next lamplight failure is detected with the predetermined number of momentary interruptions set for each of lamplight units.

DETAILED DESCRIPTION OF THE PREFERRED EMBODIMENTS

The following is an explanation of embodiments of the invention with reference to drawings.

Figure 1:
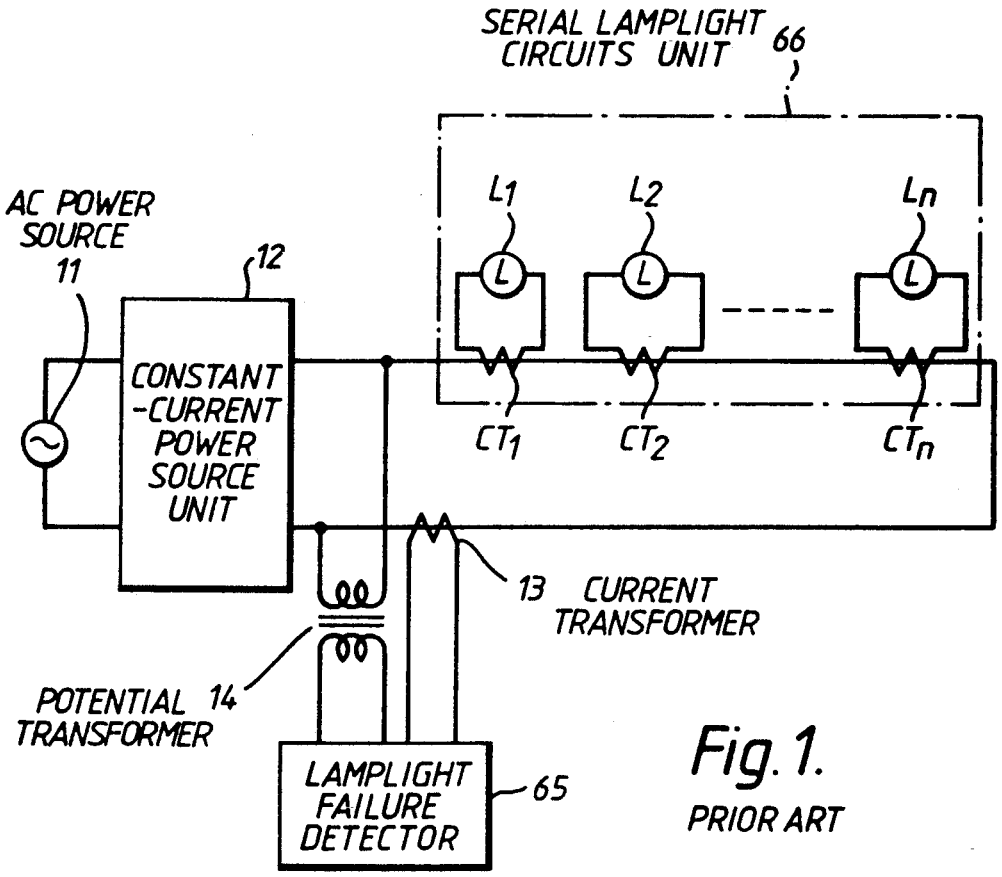
Fig. 1. PRIOR ART
FIG. 1 is a circuit diagram showing a conventional lamplight failure detector.
Figure 2A:
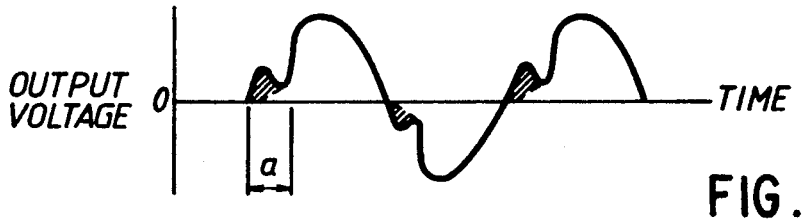
FIG. 2(a) PRIOR ART
FIG. 2 is a time-chart illustrating the changes in the wave forms of the output voltage and output current of the constant current power source caused by lamplight failure.
Figure 2B:
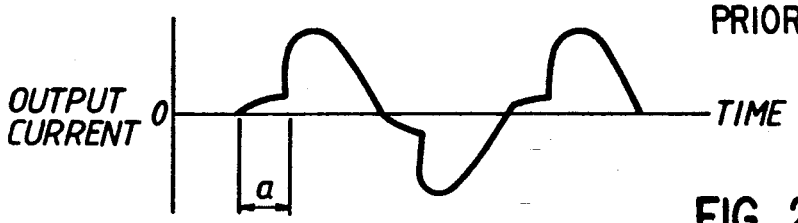
FIG. 2(b) PRIOR ART
Figure 3:
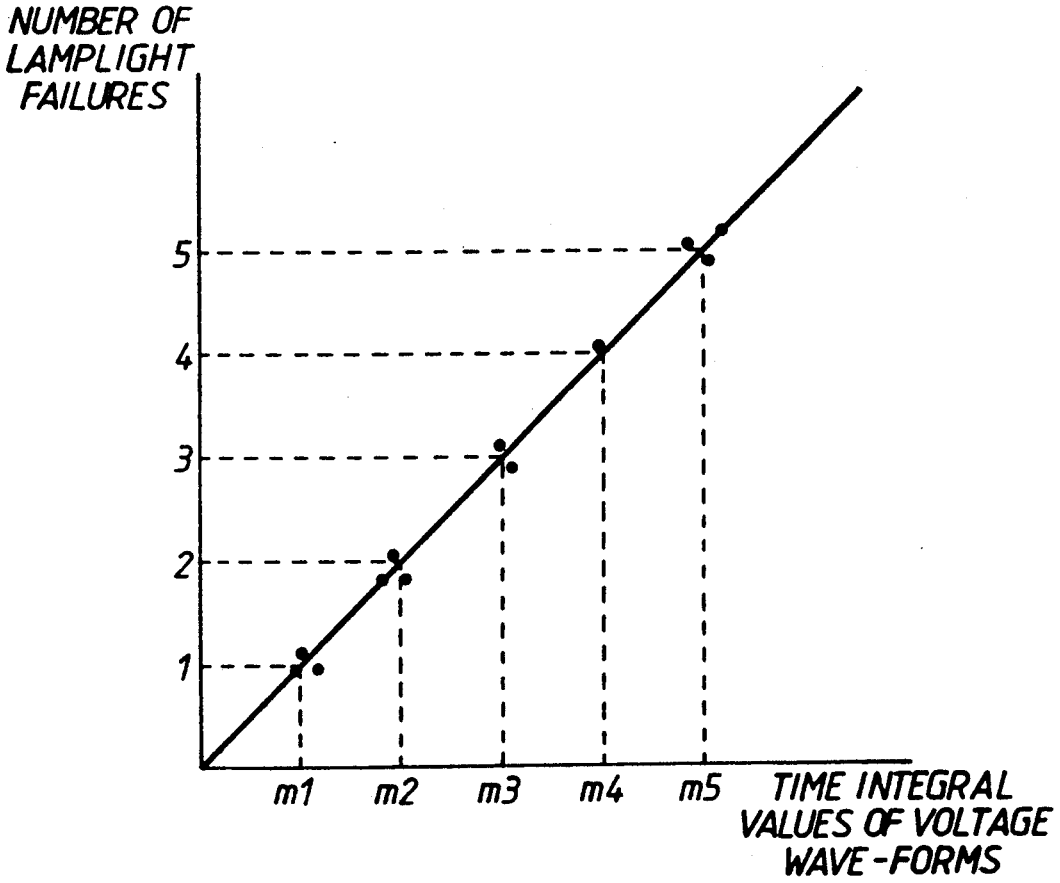
Fig. 3. PRIOR ART
FIG. 3 is a view showing the relationship between the time integral value of the output voltage of the constant current power source unit and number of lamps which have experienced lamplight failure.
Figure 4:
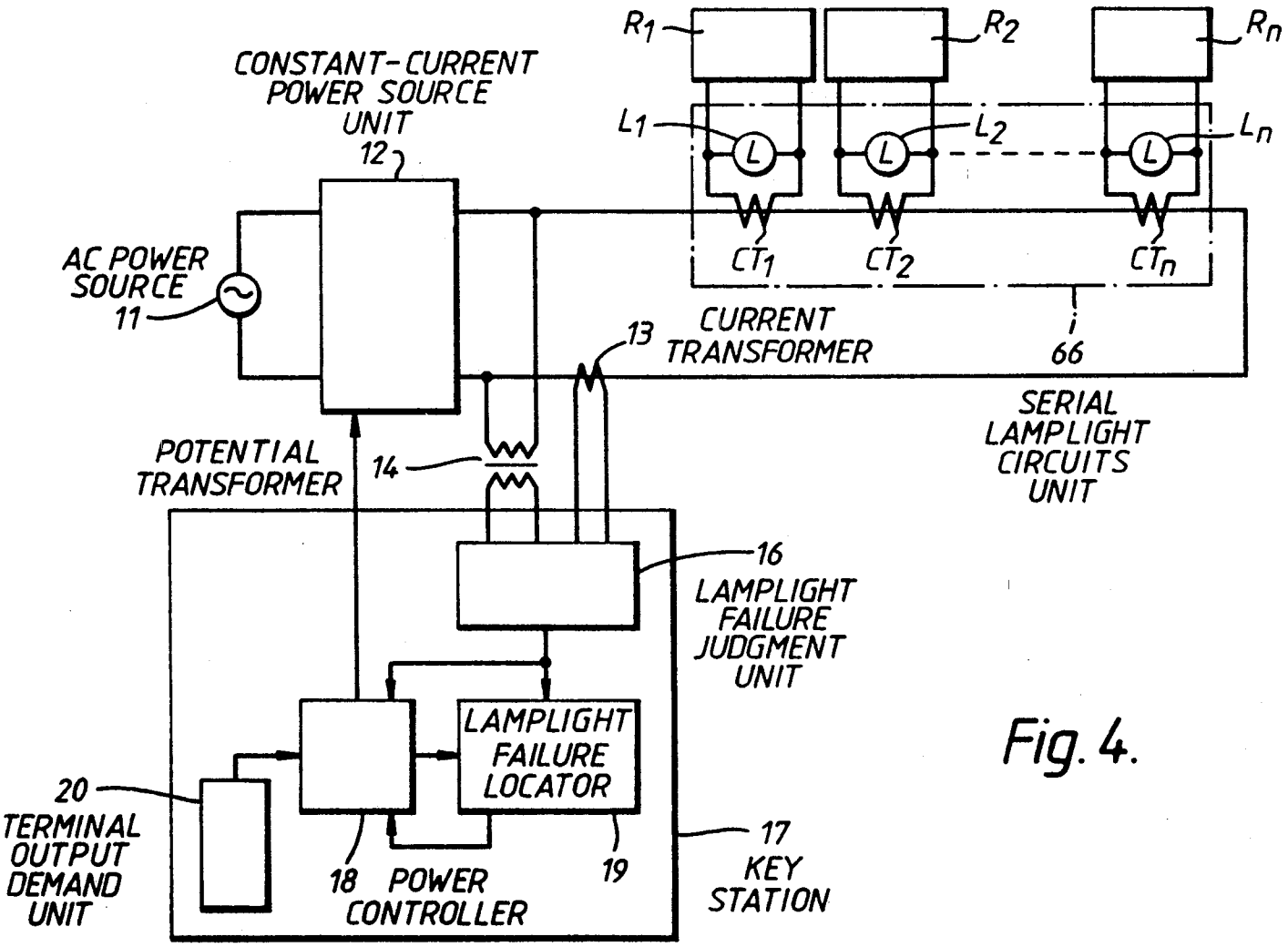
FIG. 4 is a circuit diagram showing a lamplight failure detection system according to an embodiment of the invention.

FIG. 4 is a circuit diagram showing an embodiment of a lamplight failure detection system according to the invention.

In FIG. 4, constant current power source unit 12 supplies a constant current output, by phase controlling the power supply from alternating current (AC) power source 11, to serial lamplight circuits unit 66. Serial lamplight circuits unit 66 has insulated current transformers $CT_1$, $CT_2 \ldots CT_n$ connected in series on the primary side circuit, which are connected on their secondary side to lamps $L_1$, $L_2 \ldots L_n$, respectively. And serial lamplight circuit unit 66 also controls the lighting of $L_1$, $L_2 \ldots L_n$. Lamps $L_1$, $L_2 \ldots L_n$ are maintained at a constant brightness by the current supplied via insulated current transformers $CT_1$, $CT_2 \ldots CT_n$ from constant current power source unit 12.

Figure 5:
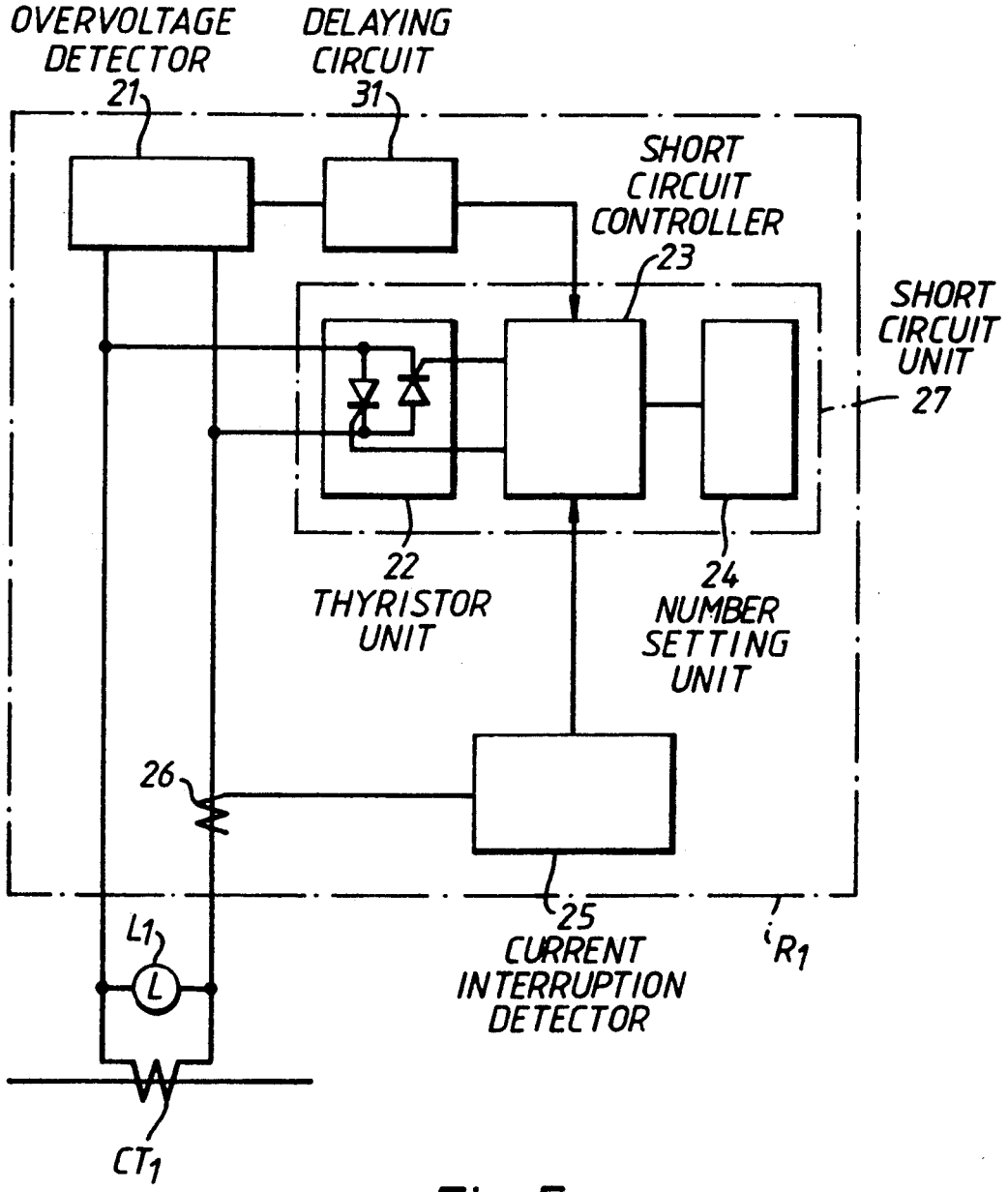
FIG. 5 is a circuit diagram showing the terminal unit shown in FIG. 4.

Terminals $R_1$, $R_2 \ldots R_n$ are fitted to, respectively, lamps $L_1$, $L_2 \ldots L_n$ and each of these has an identical configuration, as shown in FIG. 5. The configuration of terminals $R_1$, $R_2 \ldots R_n$ is described in more detail later, with reference to FIG. 5.

In the system shown in FIG. 4, key station 17 is connected to the output side of the constant current power source unit 12. Key station 17 detects the output from constant current power source unit 12 and controls constant current power source unit 12. Key station 17 consists of lamplight failure judgement unit 16, a unit for controlling the AC power source such as power controller 18, lamplight failure locator 19, and terminal output demand unit 20.

Lamplight failure judgement unit 16 is connected to a current transformer 13 and potential transformer 14. Lamplight failure judgement unit 16 detects whether a lamplight failure has occurred in any of $L_1$, $L_2 \ldots L_n$ by, for example, a unit similar to lamplight failure detector 65, described above. The results of this detection is output to lamplight failure locator 19. Lamplight failure judgement unit 16 detects when the secondary side circuit of any current transformer is opened and outputs the results of this detection to lamplight failure locator 19.

Power controller 18 in key station 17 controls the output of constant current power source unit 12. Power controller 18 causes momentary interruptions to the power source unit to the lamps but these are of a duration, e.g. 1 cycle, which have no adverse effect on the lighting of the lamp and occur at a fixed period (e.g. every 10 cycles or periods longer than 10 cycles). (This is referred to henceforth as "momentary interruption"). Lamplight failure locator 19 records in memory the standard counted values for the number of momentary interruptions, pre-set to be different for each lamp $L_1$, $L_2 \ldots L_n$. Lamplight failure locator 19 begins to count the number of momentary interruptions of the output of constant current power source 12 due to the control operation of power controller 18 from the primary momentary interruption after the output of the signal caused by the detection of a lamplight failure of any lamp by lamplight failure judgement unit 16. Lamplight failure locator 19 stops counting of the number of momentary interruptions at the time when a signal confirming that the short circuit is cancelled is received and compares this total with each of the standard values. It finds the standard counted value which corresponds to this counted value and thus determines that the lamp which corresponds to this standard counted value is the lamp where the lamplight failure has occurred.

A more detailed description of the standard values for the number of momentary interruptions which differ for each lamp is given below.

FIG. 5 is a circuit diagram of the internal configuration of terminal $R_1$, one of the series $R_1$, $R_2 \ldots R_n$. As the internal configurations of all of the series $R_1$, $R_2 \ldots R_n$ are identical, only the internal configuration of terminal $R_1$ is shown for convenience.

In FIG. 5, a lamplight failure detector such as overvoltage detector 21 and a short circuit controller such as short circuit unit 27 are connected to the secondary side circuit of insulated current transformer $CT_1$ so that each is in series with lamp $L_1$. Current interruption detector 25 is connected via current transformer 26 to the secondary side circuit of insulated current transformer $CT_1$. This current interruption detector 25 is connected to the short circuit controller 23 of short circuit unit 27. Overvoltage detector 21 is set at a high impedance such that current from the secondary side circuit of insulated current transformer $CT_1$ does not flow in. The delaying circuit 31 delays the output signal from overvoltage detector 21 by several cycles and then outputs to short circuit controller 23. Short circuit unit 27 consists of short circuit controller 23, thyristor unit 22 and number setting unit 24. Thyristor unit 22 short circuits to the secondary side circuit of insulated current transformer $CT_1$ under the control of short circuit controller 23.

Current interruption detector 25 is short circuited by thyristor unit 22 on the secondary side circuit of the insulated current transformer $CT_1$ and then the momentary interruption of the constant current power source unit due to the control operation of power controller 18 becomes detectable. Each time current interruption detector 25 detects a momentary interruption via current transformer 26 it outputs a specified detection signal to short circuit controller 23. Number setting unit 24 sets a specified number deciding the timing at which short circuit controller 23 cancels the short circuit caused by the thyristor unit.

Thus, one standard counted value of the momentary interruptions is set beforehand in the number setting unit 24 and this standard counted value is output to short circuit controller 23. The standard counted value is set so that it is different for each terminal so that, for example, it is $n_1$ for terminal $R_1$, $n_2$ for terminal $R_2$ . . . $n_n$ for terminal $R_2$. Short circuit controller 23 receives the output signal from current interruption detector 25 and the signal output from overvoltage detector 21 via the delaying circuit 31 and controls thyristor unit 22. That is, when short circuit controller 23 detects that a lamplight failure has occurred in lamp $L_1$ on the basis of the signal output from overvoltage detector 21 via delaying circuit 31, thyristor unit 22 is controlled and the secondary side circuit of insulated current transformer $CT_1$ is short circuited. When signals from the current interruption detector 25 indicating the detection of momentary interruptions are detected, the short circuit controller 23 counts these. When short circuit controller 23 detects that the counted value matches the standard count value output from the output from number setting unit 24, thyristor unit 22 is controlled at this time and the short circuit is removed for a fixed number of cycles $T_1$.

The operations of the lamplight failure detection system are described next. When lamp $L_1$ experiences a lamplight failure, there is a change in the output from constant current power source unit 12 and this change is detected by lamplight failure judgement unit 16 which outputs a signal lamplight failure locator 19. The secondary side circuit of insulated current transformer $CT_1$ enters a state similar to open and overvoltage occurs. This overvoltage is detected by overvoltage detector 21 of terminal $R_1$ and this outputs a detection signal to short circuit controller 23 indicating that overvoltage has occurred. When short circuit controller 23 receives this detection signal, it controls the thyristor unit 22 after a fixed number of cycles $T_1$ and thus short circuits the secondary side circuit of insulated current transformer $CT_1$. The lamplight failure of lamp $L_1$ is thus in a state of not being detected by the lamplight failure judgement unit 16.

Figure 6:
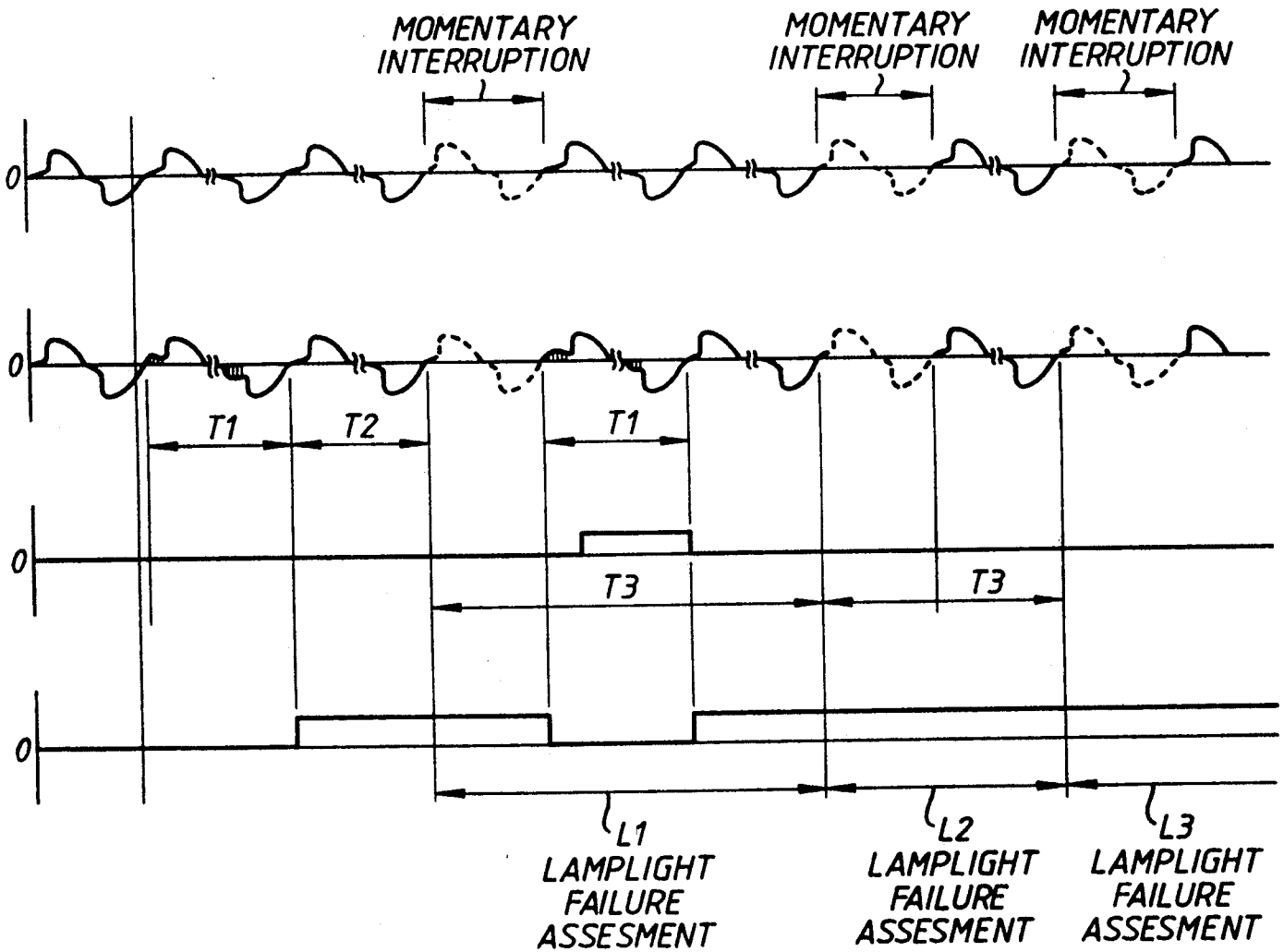
FIG. 6 is a time chart showing the changes in the output voltage and output current wave forms of the constant current power source unit, the lamplight failure detection signal of the lamplight failure detector and the short circuit signal of the short circuit controller.

On the other hand, when a momentary interruption of the constant-current power source unit 12 is caused by the power source controller 18 in this state, the current (FIG. 6 (*a*)) and voltage (FIG. 6 (*b*)) output from constant-current power source 12 become 0, as shown in the dotted line section of FIG. 6. These momentary interruptions are repeated at a fixed period of $T_3$ cycles (time). When momentary interruption of the output of constant-current power source unit 12 is caused by power controller 18, current interruption detector 25 at terminal $R_1$, detects this momentary interruption signal and outputs to short circuit controller 23. When the short circuit controller 23 receives these outputs, it counts them and when this number reaches the standard number of momentary interruption $n_1$ set by number setting unit 24, it controls thyristor unit 22 and, as shown in FIG. 6, the short circuit is removed for a time $T_1$. As is clear from FIG. 6, the relationship between $T_1$ and $T_3$ is $T_3 > T_1$. When the short circuit is thus cancelled, a change occurs in the output voltage wave form due to lamplight failure in lamp $L_1$ (FIG. 6 (*b*)) and this is detected by the lamplight failure detector by the time integral method described above. It decides that lamplight failure has occurred and reports this to lamplight failure locator 19.

More specifically, lamplight failure locator 19 of key station 17 compares the number of times that power controller 18 has caused a momentary interruption in the output of constant-current power source unit 12 from the start of counting of momentary interruptions to when the specified signal is output by lamplight failure judgement unit 16, with the standard values of times $n_1$, $n_2$ . . . $n_n$ determined for each lamp in the series $L_1$, $L_2$ . . . $L_n$.

If the counted number matches the standard number $n_1$, it decides that lamplight failure has occurred in lamp $L_1$.

If lamplight failure has occurred in lamp $L_2$, the secondary side circuit of insulated current transformer $CT_2$ is in a state similar to open and overvoltage occurs. At this time, in a similar state as described above, lamplight failure judgement unit 16 detects the lamplight failure in this lamp and outputs a signal to lamplight failure location judgement unit 19. Overvoltage detector 21 of terminal $R_2$ detects this overvoltage and it outputs a detection signal indicating that overvoltage has occurred to short circuit controller 23.

When short circuit controller 23 receives this output signal, it short-circuits the secondary side circuit of insulated current transformer $CT_2$ by controlling thyristor unit 22 after a fixed number of cycles $T_1$ and, due to this, the lamplight failure of lamp $L_2$ enters a state in which it cannot be detected by lamplight failure judgement unit 16.

On the other hand, when a momentary interruption of the constant-current power source unit 12 is caused by the power source controller 18 in this state, the current (FIG. 6 (*a*)) and voltage (FIG. 6 (*b*)) outputs from constant-current power source unit 12 become 0, as shown in the dotted line section of FIG. 6. These momentary interruptions are repeated at a fixed period of $T_3$ cycles (time). When momentary interruption of the output of constant-current power source unit 12 is caused by power controller 18, current interruption detector 25 at terminal $R_2$ detects this momentary interruption signal and outputs a signal to short circuit controller 23. When the short circuit controller 23 receives these outputs, it counts them and when this counted value reaches the standard number of momentary interruptions $n_2$ set by number setting unit 24, it controls thyristor unit 22 and, as shown in FIG. 6 (*d*), the short circuit is removed for a time $T_1$.

As is clear from FIG. 6, the relationship between $T_1$ and $T_3$ is $T_3 > T_1$. When the short circuit is thus cancelled, a change occurs in the output voltage wave form due to lamplight failure in lamp $L_2$ (FIG. 6 (*b*)) and this is detected by lamplight failure detector by the time integral method described above. It decides that lamplight failure has occurred and reports this to lamplight failure locator 19.

Lamplight failure locator 19 compares the number of times that power controller 18 has caused a momentary interruption in the output of constant-current power source unit 12 and if the number of times when the specified signal is output from lamplight failure judgement unit 16 matches the standard number of times $n_2$, it decides that lamplight failure has occurred in lamp $L_2$. It is necessary to ensure times $T_1$ at which the short circuits are cancelled at terminals $R_1$–$R_n$ of the lamps all differ from each other so that, when lamplight failure has occurred in more than one lamp, it is possible to identify accurately where these lamplight failures have occurred.

Next is described the detection operations of the lamp light failure detection system in a case in which lamplight failure occurs simultaneously in lamp $L_1$ and Lamp $L_2$. When lamplight failure occurs simultaneously in Lamp $L_1$ and $L_2$, the secondary side circuits of insulated current transformers $CT_1$ and $CT_2$ enter a state close to open and overvoltage occurs. At this time, in the state previously described, lamplight failure judgement unit 16 detects the two lamplight failures in the lamps and outputs a signal to the lamplight failure locator 19. Overvoltage is detected at both overvoltage detector 21 at terminal $R_1$ and overvoltage detector 21 at terminal $R_2$, the secondary side circuits of insulated current transformers $CT_1$ and $CT_2$ are short circuited by short circuit unit 27 at terminals $R_1$ and $R_2$. The number of times that the output of constant-current power source unit 12 is subjected to momentary interruption by power controller 18 is counted by short circuit controllers at terminals $R_1$ and $R_2$ and the short circuit is cancelled when the values reaches $n_1$ in the case of $R_1$ and $n_2$ in the case of $R_2$. Since terminals $R_1$ and $R_2$ remove the short circuits for time $T_1$ when the counted value reaches $n_1$ in the case of $R_1$ and $n_2$ in the case of $R_2$, the lamplight failure judgement unit 16 is capable of detecting that lamplight failures have occurred and it is also possible, by the process described above, for the lamplight failure locator to detect that these lamplight failures have occurred at lamp $L_1$ and $L_2$.

Since if a lamplight failure has not occurred in any lamp, the secondary side circuits of insulated current transformers $CT_1$-$CT_n$ are not short circuited even when momentary interruptions of the output of the constant-current power source are controlled by power controller 18, no change occurs. Thus because the secondary side circuits of insulated current transformers $CT_1$-$CT_n$ cannot be short-circuited and the short circuits cannot be temporarily cancelled, lamplight failure judgement unit 16 does not detect any change in the output of constant-current power source unit 12 produced by the temporary cancellation of the short circuits at the secondary side circuits of the insulated current transformers and thus no detection is reported to lamplight failure locator 19. Therefore, there is no counted value for the number of momentary interruptions for lamplight failure locator 19 to compare with standard numbers of momentary interruptions, it makes the judgement that all lamps are normal.

Since, as has been explained, it is possible for this embodiment of the lamplight failure detector to detect and locate lamplight failure with certainty, there is no necessity for an inspector to search for lamps with lamplight failures on the runway and there is thus a considerable improvement in maintenance and checking efficiency. Also, since the period of the momentary interruptions of the output of the constant-current power source unit 12 by power controller 18 is short, it is possible to detect lamplight failure a short time after a lamp has failed. Since, in cases when lamplight failure has occurred in any of the lamps $L_1$, $L_2$ . . . $L_n$, the secondary sides of insulated current transformers $CT_1$, $CT_2$ . . . $CT_n$, enter a state which is equivalent to that when no lamplight failure has occurred and the short circuit at the secondary side circuits of $CT_1$, $CT_2$ . . . $CT_n$ is only cancelled for a short time $T_1$, it is possible to avoid prolonged overvoltage at the secondary side circuits of insulated current transformers $CT_1$, $CT_2$ . . . $CT_n$. This prevents short circuits in the coils of $CT_1$, $CT_2$ . . . $CT_n$ and heat damage by high temperatures.

Figure 7:
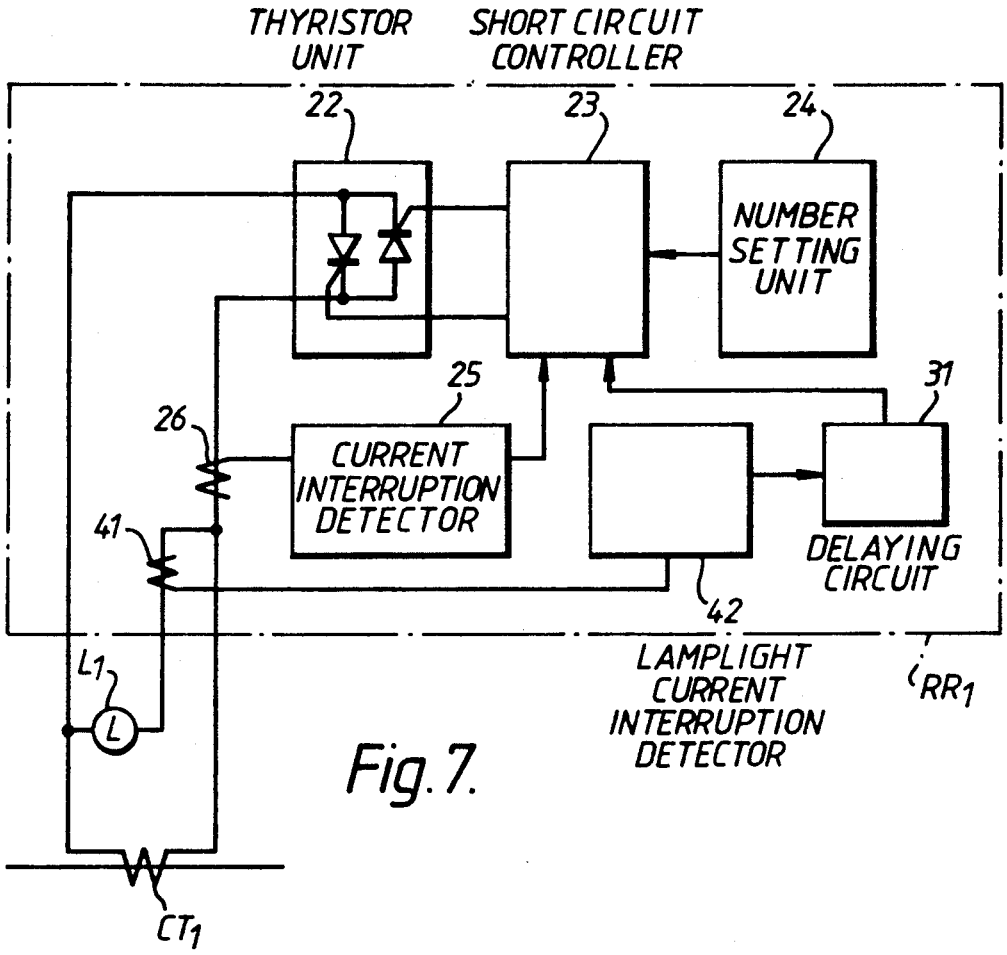
FIG. 7 is a circuit diagram showing the terminal unit according to another embodiment of the invention.

Next, another embodiment according to the invention is described. In this embodiment according to the invention, the configuration of terminals $R_1$, $R_2$ . . . $R_n$ (FIG. 5) differs from the embodiment described above and this is shown as $RR_1$ in FIG. 7. In terminal $R_1$ shown in FIG. 5, overvoltage detector 21 is used as the unit for detecting lamplight failure and a lamplight failure in lamp $L_1$ is detected by the detection of overvoltage produced at the secondary side circuit of insulated current transformer $CT_1$. By contrast, in terminal $RR_1$, interruption of the electrical current flowing to lamp $L_1$ caused by lamplight failure is detected by lamplight current interruption detector 42, via a current transformer 41 connected in series. It thus differs as to the method by which lamplight failures are detected. Thus it is identical with the embodiment according to the invention except for the method by which a lamplight failure in lamp $L_1$ is detected.

Both of these embodiments are embodiments of the lamplight failure detection system according to the invention but the scope of the invention is not limited by them. For example, in the examples above, the unit of short-circuiting the secondary side circuits of insulated current transformers $CT_1$, $CT_2$-$CT_n$ is a thyristor unit, which switches between short circuit and open, but another method of doing this may be used. Also it is not absolutely necessary for lamplight failure locating operations to be carried out automatically at a fixed period by lamplight failure locator 19 and, similarly there is no absolute need for momentary interruptions of the output of constant-current power source unit 12 by power controller 18 to be carried out frequently. For example, lamplight failure locating operations may be carried out several times if each time is normal or the operator may search for lamplight failure by momentarily interrupting the output manually.

As is clear from FIG. 6, the process may be one in which there is no short circuit of the secondary side circuit of the insulated current transformer by short circuit controller 23 immediately after overvoltage detector 21 (or lamplight current interruption detector 42) detects that lamplight failure has occurred but rather the short circuit is imposed after the passage of $T_1$ cycles. During this time, the lamplight failure locator 19 of key station 17 decides that a lamplight failure has occurred in one of the lamps and only in this case is the output of constant-current power source subjected to repeated momentary interruptions by the power controller 18 and the location of the lamplight failure thus determined. In FIG. 6, $T_2$ shows the cycles necessary to reset the number of momentary interruptions in the short circuit controllers 23 of the terminals. $T_2$ is set such that $T_2 > T_3$.

Figure 8:
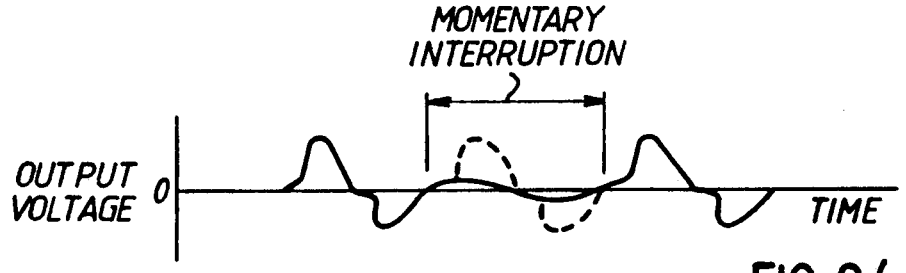
FIG. 8 is a time chart showing the changes in the output voltage and output current wave forms of the constant current power source unit shown in FIG. 7.
Figure 8B:
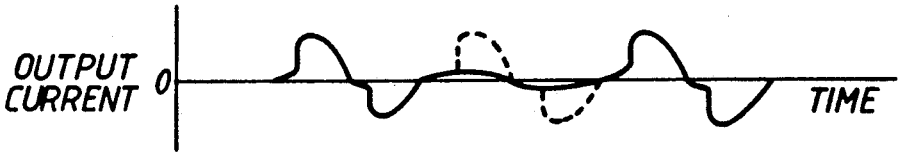

In both of the embodiments of the invention described above, the momentary interruptions of the output of constant-current power source unit 12 by power controller 18 is performed by setting the output voltage and output current of the constant-current power source to 0 but generally, since the constant-current power source unit 12 has both a power source which lights the lamps and a power source which produces a base current, only the lighting power source may be set to 0 and the base power source not set to 0. The wave form of the output voltage and output current during momentary interruption of the output in such cases in shown in FIG. 8.

As has been explained above, in the system according to the invention, a different number of momentary interruptions of the alternating power output is set for each lamp. After the lamplight failure judgement unit has detected that a lamplight failure has occurred it counts the number of momentary interruptions and compares the number of interruptions until the lamplight failure judgement unit again detects that a lamplight failure has occurred against the set values for each lamp. Thus it can be detected that a lamplight failure has occured in the lamp the set number of which matches the counted number. The invention is thus able to provide a lamplight failure detection system which is capable of detecting which of a series of lamps has experienced a lamplight failure.

What is claimed is:

1. A lamplight failure detection system for detecting lamplight failure in a lamplight circuit, the lamplight circuit having a plurality of lamplight units and each of a plurality of current transformers, the current transformers each having a primary side circuit connected in series to an alternating current power supply and a secondary side circuit connected to a corresponding one of the lamplight units, the lamplight failure detection system comprising:

a plurality of lamplight failure detector means fitted to each of the lamplight units for detecting a lamplight failure in the corresponding lamplight unit;

power control means for performing repeatedly the momentary interruption of the output of the alternating power supply;

a plurality of lamplight circuit control means fitted to each of the lamplight failure detector means for electrically closing the secondary side circuit of the current transformer when a lamplight failure is detected by the lamplight failure detector means and for opening the secondary side circuit for a fixed time when the number of momentary interruptions of the alternating current power supply which occur after the lamplight failure is detected reaches a predetermined number of momentary interruptions for each lamplight unit;

lamplight failure judgement means for detecting lamplight failure based on variations in the output of the alternating current power supply; and lamplight failure locator means for deciding which of the lamplight units has failed based on a comparison between the number of momentary interruptions from the time a first lamplight failure is detected to when the next lamplight failure is detected, with the predetermined number of momentary interruptions set for each lamplight unit.

2. The lamplight failure detection system of claim 1, wherein the lamplight failure detector means comprises means for detecting lamplight current interruption caused in the secondary side circuit of the current transformer.

3. The lamplight failure detection system of claim 1, wherein the lamplight failure detector means comprises means for detecting overvoltage of the secondary side circuit of the current transformer.

4. The lamplight failure detection system of claim 1, wherein the lamplight circuit control means includes means for controlling the electrical closing and opening of the secondary side circuit of the current transformer, means for counting the number of momentary interruptions of output of the alternating current power supply according to a specified condition, and number setting means for storing the predetermined number of momentary interruptions set.

5. A method of detecting lamplight failure in a lamplight circuit, the lamplight circuit having a plurality of lamplight units and a plurality of current transformers, the current transformers each having a primary side circuit connected in series to an alternating current power supply and a secondary side circuit connected to a corresponding one of the lamplight units, the method comprising the steps of:

detecting a lamplight failure in the corresponding lamplight unit;

performing repeatedly the momentary interruption of the output of the alternating power supply;

electrically closing the secondary side circuit of the current transformer when a lamplight failure is detected;

electrically opening the secondary side circuit for a fixed time when the number of momentary interruptions of the alternating current power supply, which occur after the lamplight failure is detected, reaches a predetermined number of momentary interruptions set for each lamplight unit;

detecting lamplight failure of the lamplight circuit based on variations in the output of the alternating current power supply; and deciding which of the lamplight units has failed based on the result of comparisons between the number of momentary interruptions from the time a first lamplight failure is detected to when the next lamplight failure is detected, with the predetermined number of momentary interruptions set for each lamplight unit.

6. The method of detecting lamplight failure of claim 5, wherein the step of detecting the lamplight failure comprises the step of detecting lamplight current interruption caused in the secondary side circuit of the current transformer.

7. The method of detecting lamplight failure of claim 5, wherein the step of detecting the lamplight failure comprises the step of detecting overvoltage of the secondary side circuit of the current transformer.

8. The method of detecting lamplight failure of claim 5, wherein the step of opening the secondary side circuit includes the step of counting the number of momentary interruptions of output of the alternating current power supply according to a specified condition, and the step of storing the predetermined number of momentary interruptions.

* * * * *

UNITED STATES PATENT AND TRADEMARK OFFICE

CERTIFICATE OF CORRECTION

PATENT NO. : 5,168,198

DATED : December 01, 1992

INVENTOR(S) : Toshisuke Watanabe

It is certified that error appears in the above-identified patent and that said Letters Patent is hereby corrected as shown below:

Claim 1, column 9, line 39, change "judgement" to --judgment--.

On the title page, Abstract final line delete "of".

Signed and Sealed this

Twenty-fifth Day of January, 1994

Bruce Lehman

*Attest:*

BRUCE LEHMAN

*Attesting Officer*

*Commissioner of Patents and Trademarks*